US010472206B2

(12) United States Patent
Roberts et al.

(10) Patent No.: US 10,472,206 B2
(45) Date of Patent: Nov. 12, 2019

(54) SENSOR FAILURE DETECTION AND FUSION SYSTEM FOR A MULTI-CAR ROPELESS ELEVATOR SYSTEM

(71) Applicant: Otis Elevator Company, Farmington, CT (US)

(72) Inventors: Randall Roberts, Hebron, CT (US); David Ginsberg, Granby, CT (US); Walter Thomas Schmidt, Marlborough, CT (US); Konda Reddy Chevva, Ellington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 363 days.

(21) Appl. No.: 15/366,648

(22) Filed: Dec. 1, 2016

(65) Prior Publication Data

US 2017/0158462 A1 Jun. 8, 2017

Related U.S. Application Data

(60) Provisional application No. 62/263,043, filed on Dec. 4, 2015.

(51) Int. Cl.
*B66B 1/34* (2006.01)
*B66B 5/00* (2006.01)
(Continued)

(52) U.S. Cl.
CPC ..... *B66B 5/0018* (2013.01); *B66B 9/003* (2013.01); *B66B 11/0407* (2013.01)

(58) Field of Classification Search
CPC ..... B66B 5/0018; B66B 9/003; B66B 11/407
(Continued)

(56) References Cited

U.S. PATENT DOCUMENTS 5,393,941 A 2/1995 Mizuno et al.
5,501,295 A 3/1996 Mueller et al.
(Continued)

FOREIGN PATENT DOCUMENTS

CN 1157794 A 8/1997
CN 101100257 A 1/2008
(Continued)

OTHER PUBLICATIONS

Du, Yi et al, "A Double-Sided Linear Primary Permanent Magnet Vernier Machine", Scientific World Journal, published Mar. 22, 2015 8 pages.
(Continued)

*Primary Examiner* — Anthony J Salata
(74) *Attorney, Agent, or Firm* — Cantor Colburn LLP

(57) ABSTRACT

A multi-car ropeless elevator system includes at least one lane. An elevator car is arranged in the at least one lane. A linear motor system includes a plurality of stationary motor primary sections extending along the at least one lane and at least one moveable motor secondary section mounted to the elevator car. A plurality of sensors is operatively connected to the linear motor system. Each of the plurality of sensors is operatively associated with a corresponding one of the plurality of stationary motor primary sections. A sensor failure detection and fusion system is operatively connected to each of the plurality of sensors. The sensor failure detection and fusion system operates to identify failures in one or more of the plurality of sensors and fuse data received from remaining ones of the plurality of sensors.

20 Claims, 2 Drawing Sheets

(51) Int. Cl.
*B66B 11/04* (2006.01)
*B66B 9/00* (2006.01)

(58) Field of Classification Search
USPC ..... 187/247, 249, 391, 393, 394
See application file for complete search history.

(56) References Cited

U.S. PATENT DOCUMENTS

| | | | | |
|---|---|---|---|---|
| 5,594,219 | A * | 1/1997 | Kamani | B66B 1/46 187/283 |
| 5,651,426 | A * | 7/1997 | Bittar | B66B 1/2458 187/249 |
| 5,751,076 | A * | 5/1998 | Zhou | B66B 11/0407 187/250 |
| 6,073,262 | A | 6/2000 | Larkin et al. | |
| 6,583,726 | B1 | 6/2003 | Johnson et al. | |
| 6,688,968 | B2 | 2/2004 | Kraftheifer | |
| 7,096,125 | B2 | 8/2006 | Padmanabhan et al. | |
| 7,353,914 | B2 * | 4/2008 | Deplazes | B66B 5/0031 187/249 |
| 7,597,176 | B2 | 10/2009 | Zaharia | |
| 7,954,607 | B2 * | 6/2011 | Kallioniemi | B66B 5/06 187/287 |
| 7,992,689 | B2 * | 8/2011 | Stolt | B66B 1/3476 187/281 |
| 8,230,977 | B2 | 7/2012 | Thumm et al. | |
| 9,010,499 | B2 | 4/2015 | McCarthy et al. | |
| 9,242,838 | B2 * | 1/2016 | Benosman | B66B 7/06 |
| 9,758,342 | B2 * | 9/2017 | Stolt | B66B 1/30 |
| 2003/0114986 | A1 | 6/2003 | Padmanabhan et al. | |
| 2014/0371914 | A1 | 12/2014 | Koba et al. | |
| 2015/0014098 | A1 | 1/2015 | Stolzl et al. | |
| 2017/0036887 | A1 * | 2/2017 | Roberts | H02K 41/031 |
| 2017/0158461 | A1 * | 6/2017 | Roberts | B66B 1/30 |

FOREIGN PATENT DOCUMENTS

| | | | |
|---|---|---|---|
| CN | 101811636 | A | 8/2010 |
| CN | 203229280 | U | 10/2013 |
| CN | 204714260 | U | 10/2015 |
| CN | 105151927 | A | 12/2015 |
| JP | 3029883 | B2 | 4/2000 |
| WO | 2014113006 | A1 | 7/2014 |
| WO | 2014158127 | A1 | 10/2014 |
| WO | 2015137969 | A1 | 9/2015 |

OTHER PUBLICATIONS

Gurbuz, Cagri et al., "Linear motor for multi car elevators: design and position measurement", Tubitak, Turk J Elec Eng & Comp Sci., vol. 19, No. 6, 12 pages.

Hongwei, Zhang, "Research on the operation control for rope-less hoist system driven by Permanent Magnet Linear Synchronous Motor", abstract, Jan. 2012, Control Conference (CCC), 2012, 31st Chinese, 3 pages.

Chinese First Office Action for application 201611101838.5, dated Aug. 15, 2019, 8 pages.

* cited by examiner

SENSOR FAILURE DETECTION AND FUSION SYSTEM FOR A MULTI-CAR ROPELESS ELEVATOR SYSTEM

CROSS-REFERENCE TO RELATED APPLICATIONS

This application claims the benefit of U.S. provisional patent application Ser. No. 62/263,043, filed Dec. 4, 2015, the entire contents of which are incorporated herein by reference.

BACKGROUND

Exemplary embodiments pertain to the art of elevator systems and, more particularly, to a sensor failure detection and fusion system for a multi-car ropeless elevator system.

Sensors are ubiquitous in systems which require monitoring of one or more qualities. Sensors may be employed to measure velocity, distance, color, temperature, pressure and the like. Often times, multiple sensors are employed to detect movement or travel along a process stream. Over time, one or more of the multiple sensors might fail or provide erroneous data. A control system relying on erroneous data may act in a manner contrary to goals of the processes stream.

BRIEF DESCRIPTION

Disclosed is a multi-car ropeless elevator system including at least one lane, an elevator car is arranged in the at least one lane. A linear motor system includes a plurality of stationary motor primary sections that extend along the at least one lane and at least one moveable motor secondary section mounted to the elevator car. A plurality of sensors is operatively connected to the linear motor system. Each of the plurality of sensors is operatively associated with a corresponding one of the plurality of stationary motor primary sections. A sensor failure detection and fusion system is operatively connected to each of the plurality of sensors. The sensor failure detection and fusion system operates to identify failures in one or more of the plurality of sensors and fuse data received from remaining ones of the plurality of sensors.

In addition to one or more of the features described above or below, or as an alternative, further embodiments could include wherein one or more of the plurality of sensors comprises velocity sensors.

In addition to one or more of the features described above or below, or as an alternative, further embodiments could include wherein one or more of the plurality of sensors comprises position sensors.

In addition to one or more of the features described above or below, or as an alternative, further embodiments could include wherein the position sensors operate to detect a presence of the elevator car in the lane adjacent to the corresponding one of the plurality of stationary motor primary sections.

In addition to one or more of the features described above or below, or as an alternative, further embodiments could include wherein the position sensors operate to detect an orientation of the elevator car in the lane relative to the corresponding one of the plurality of stationary motor primary sections.

In addition to one or more of the features described above or below, or as an alternative, further embodiments could include a motion control system operable to control a position of the elevator car in the lane, the sensor failure detection and fusion system providing at least one of a position and a velocity feedback of the elevator car to the motion control system.

In addition to one or more of the features described above or below, or as an alternative, further embodiments could include wherein the plurality of stationary motor primary sections includes a first plurality of stationary motor primary sections arranged along a first side of the lane and a second plurality of stationary motor primary sections arranged along a second, opposing side of the lane.

In addition to one or more of the features described above or below, or as an alternative, further embodiments could include wherein the plurality of sensors includes a first plurality of sensors associated with corresponding ones of the first plurality of stationary motor primary sections and a second plurality of sensors associate with the second plurality of stationary motor primary sections.

In addition to one or more of the features described above or below, or as an alternative, further embodiments could include wherein the sensor failure detection and fusion system operates to calibrate one or more of the plurality of sensors based on differences in signals sensed by at least a portion of the plurality of sensors.

Also disclosed is a method of detecting faults and fusing sensors for a multi-car ropeless elevator system. The method includes activating one or more of a plurality of stationary motor primary sections to shift an elevator car along a lane, receiving signals from one or more of a plurality of sensors associated with corresponding ones of the plurality of stationary motor primary sections, determining a faulty sensor based on differences in the signals received by a portion of the plurality of sensors, fusing signals from remaining ones of the portion of sensors, and determining a parameter of the elevator car based on the fused signals.

In addition to one or more of the features described above or below, or as an alternative, further embodiments could include wherein determining the faulty sensor includes comparing sensor values received from a plurality of active sensors.

In addition to one or more of the features described above or below, or as an alternative, further embodiments could include wherein fusing signals from remaining ones of the portion of sensors includes combining signals from a plurality of active sensors of the remaining ones of the portion of sensors excluding the faulty sensor to establish a single fused signal output.

In addition to one or more of the features described above or below, or as an alternative, further embodiments could include wherein combining the signals includes averaging the signal output of each of the remaining ones of the plurality of sensors.

In addition to one or more of the features described above or below, or as an alternative, further embodiments could include wherein determining the parameter of the elevator car includes detecting a position of the elevator car along the lane based on the fused signals.

In addition to one or more of the features described above or below, or as an alternative, further embodiments could include wherein determining the parameter of the elevator car includes detecting a velocity of the elevator car along the lane.

In addition to one or more of the features described above or below, or as an alternative, further embodiments could include wherein determining the parameter of the elevator car includes detecting an orientation of the elevator car relative to the plurality of stationary motor primary sections.

In addition to one or more of the features described above or below, or as an alternative, further embodiments could include calibrating one or more of the plurality of sensors based on differences between signals received from a portion of the plurality of signals.

In addition to one or more of the features described above or below, or as an alternative, further embodiments could include wherein calibrating the one or more of the plurality of sensors includes detecting differences below a predetermined error bounds between one or more of the portion of the plurality of signals.

In addition to one or more of the features described above or below, or as an alternative, further embodiments could include controlling movement of the elevator car along the lane with a motion control system based on the parameter of the elevator car.

In addition to one or more of the features described above or below, or as an alternative, further embodiments could include wherein controlling movement of the elevator car includes controlling velocity and position of the elevator car in the lane.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
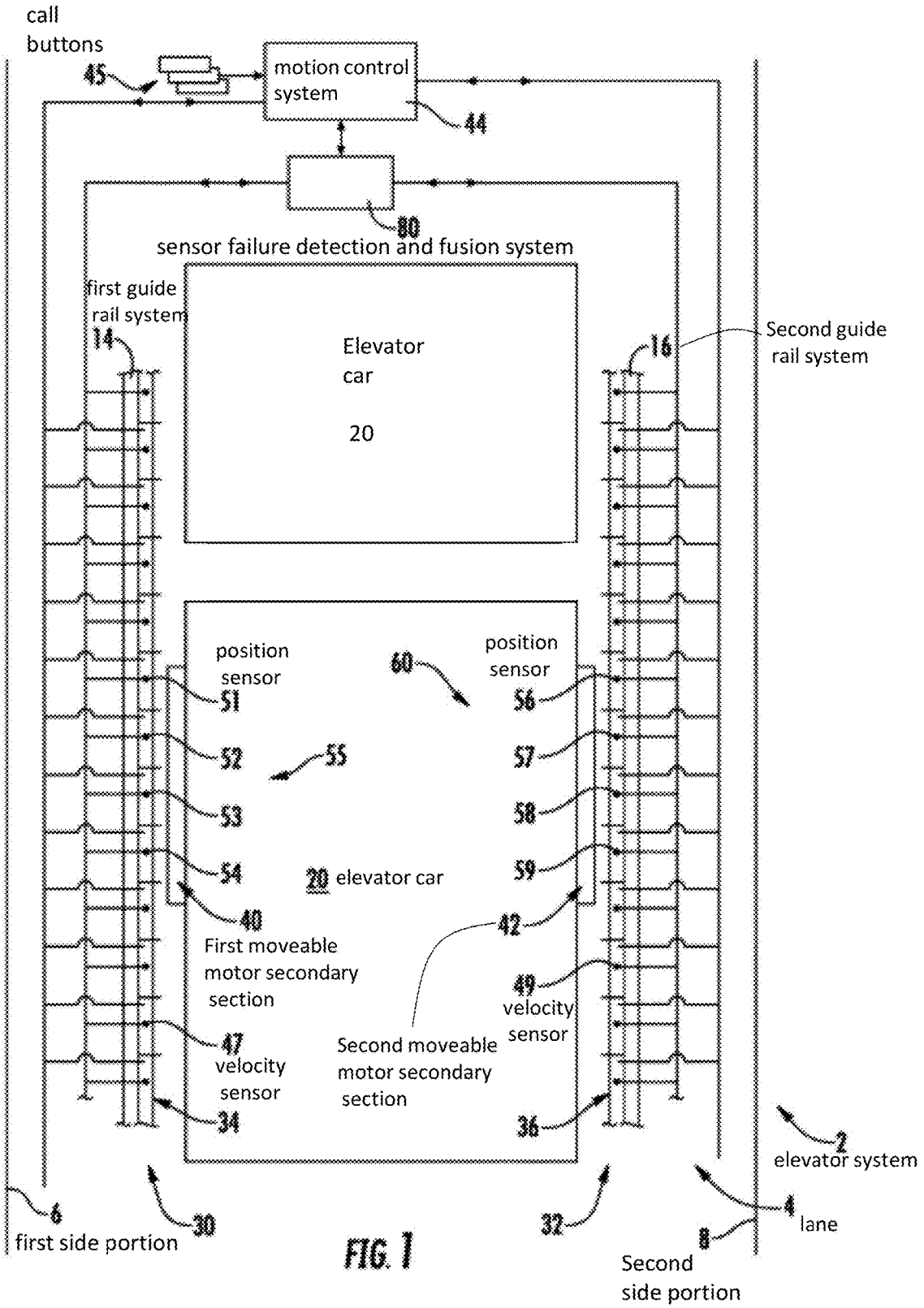
FIG. 1 depicts a multi-car ropeless (MCRL) elevator system including a sensor failure detection and fusion system, in accordance with an exemplary embodiment.

A multi-car ropeless (MCRL) elevator system, in accordance with an exemplary embodiment, is indicated generally at 2 in FIG. 1. MCRL elevator system 2 includes a lane 4 having a first side portion 6 and a second side portion 8. It should be understood that first and second side portions 6 and 8 may be defined by walls or by a boundary that may exist between adjacent lanes. In the exemplary embodiment shown, a first guide rail system 14 extends along first side portion 6 and a second guide rail system 16 extends along second side portion 8. First and second guide rail systems 14 and 16 support and guide an elevator car 20 traversing along lane 4 and/or between adjacent lanes (not shown).

In the exemplary embodiment shown, MCRL elevator system 2 includes a first linear motor system 30 arranged between first side portion 6 and elevator car 20, and a second linear motor system 32 arranged between second side portion 8 and elevator car 20. First and second linear motor systems 30 and 32 shift elevator car 20 along lane 4. In addition to shifting vertically along lane 4, elevator car 20 may also shift horizontally between adjacent lanes. Further, while shown as including two linear motor systems, MCRL elevator system may be operated with a single linear motor system or three or more linear motor systems.

First linear motor system 30 includes a plurality of stationary motor primary sections, one of which is indicated at 34, extending along lane 4 adjacent to first guide rail system 14. Second linear motor system 32 includes a second plurality of stationary motor primary sections, one of which is indicated at 36 extending along lane 4 adjacent to second guide rail system 16. First linear motor system 30 also includes a first moveable motor secondary section 40 mounted to a first side (not separately labeled) of elevator car 20. Second linear motor system 32 includes a second moveable motor secondary section 42 mounted to a second, opposing side (also not separately labeled) of elevator car 20.

First and second moveable motor secondary sections 40 and 42 are acted upon by first and second pluralities of stationary motor primary sections to shift elevator car 20 along lane 4. More specifically MCRL elevator system 2 includes a motion control system 44 operatively connected to teach of the first and second pluralities of stationary motor primary sections 34 and 36 and one or more call buttons 45. Motion control system 44 energizes select ones of first and second stationary motor primary sections to shift elevator car 20 along lane 4 at a desired velocity and to a desired position (floor). At this point, it should be understood that MCRL elevator system 2 may include additional controllers that provide supervisory control, dispatching control and the like. Further, it should be understood that a passenger interface may be provided at destination entry kiosks in addition to, or in lieu of call buttons 45.

In accordance with an exemplary embodiment, a first plurality of sensors, 47 extend along lane 4. Each of the first plurality of sensors 47 is associated with a corresponding one of the first plurality of stationary motor primary sections 34. A second plurality of sensors 49 also extend along lane 4. Each of the second plurality of sensors 49 is associated with a corresponding one of the second plurality of stationary motor primary sections 36. In accordance with an aspect of an exemplary embodiment, a portion of the first plurality of sensors 47, e.g., sensors 51-54 may constitute a first group of active sensors 55. Similarly, a portion of the second plurality of sensors 49, e.g., sensors 56-59 may constitute a second group of active sensors 60. "Active sensors" should be understood to describe sensors that are engaged in sensing one or more parameters of elevator car 20 at a particular instant of time given the position of elevator car 20. The particular ones of first and second pluralities of sensors deemed to be active sensors will vary as elevator car 20 traverses along lane 4. First and second pluralities of sensors 47 and 49 may take the form of load sensors, accelerometers, position sensors, orientation sensors and the like. First and second pluralities of sensors 47 and 49 may be employed to determine a position, a velocity and/or an orientation of elevator car 20 in lane 4. That is, in addition to detection of velocity and/or position, the first and second pluralities of sensors 47 and 49 may also detect whether elevator car 20 has rolled, yawed or otherwise shifted from a desired orientation while traversing lane 4.

In accordance with an exemplary embodiment, first and second pluralities of sensors 47 and 49 are operatively coupled to a sensor failure detection and fusion system 80. Sensor failure detection and fusion system 80 may take the form of a single, integrated system, or a number of operatively associated components that may be co-located, or distributed along, for example, lanes 4. As will be detailed more fully below, sensor failure detection and fusion system 80 identifies whether any of the first and second pluralities of sensors 47 and 49 are faulty, and fuses or joins outputs from healthy sensors to determine a parameter of elevator car 20. At this point, it should be understood that the term "fuses" means combining outputs from multiple sensors to provide a parameter output. Combining outputs may include determining an average or mean value of the outputs, determining a median value of the outputs, and/or a mode of the outputs. A fused signal output may then be sent to motion control system 44 which, in turn, may interact with first and second pluralities of stationary motor primary sections 34 and 36 to guide elevator car 20 to a desired position at a desired velocity along lane 4.

Figure 2:
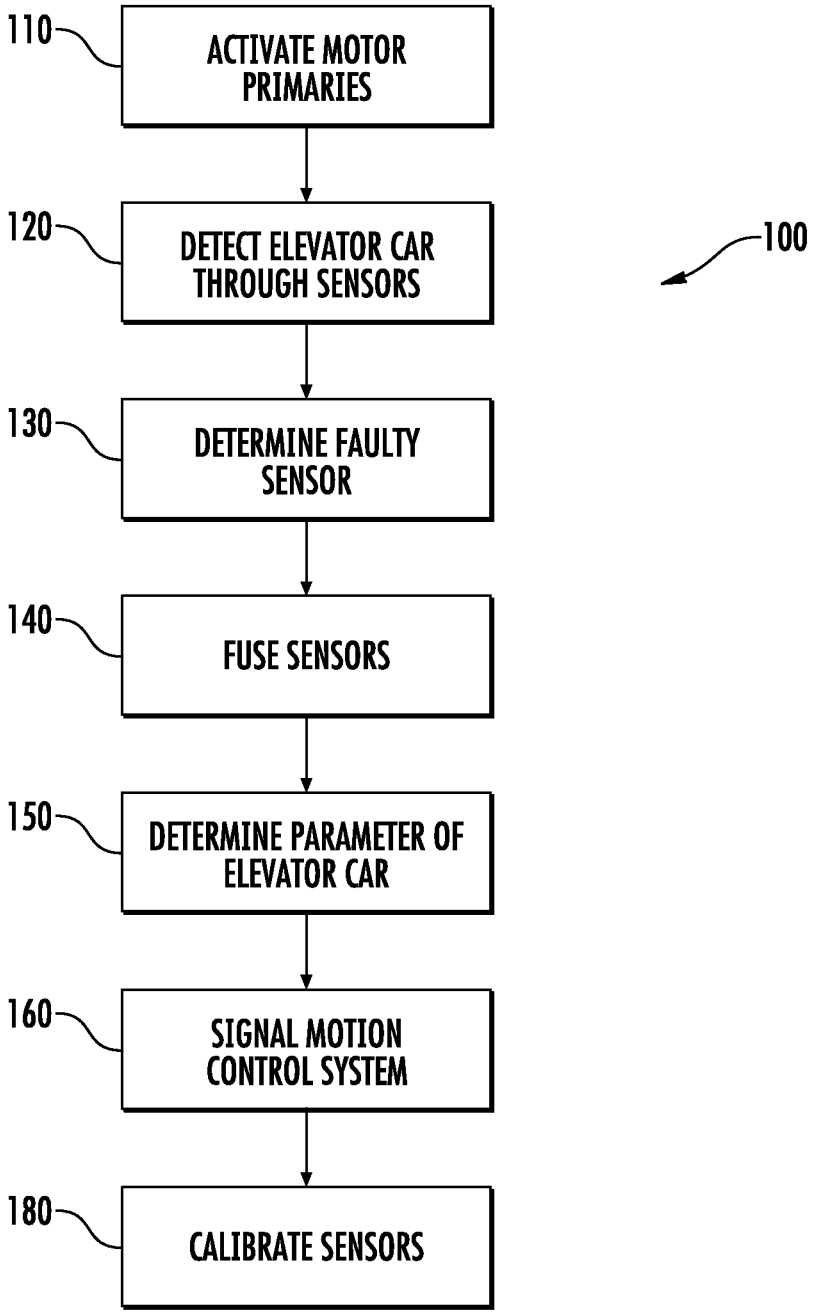
FIG. 2 is a flow chart depicting a method of detecting faults and fusing sensors, in accordance with an exemplary embodiment.

Reference will now follow to FIG. 2 in describing a method 100 of detecting faults in, and fusing outputs from first and second pluralities of sensors 47 and 49. In block 110, first and second pluralities of stationary motor primary sections 34 and 36 are activated to shift elevator car 20 to a desired position. Movement of elevator car 20 is detected by select ones of the first and second pluralities of sensors 47 and 49 in block 120. The select ones of the pluralities of sensors 47 and 49 actually detecting elevator car 20 form active sensors. Sensor failure detection and fusion system 80 receives signals from each active sensor. If a signal from any of the active sensors differs significantly from signals from others of the active sensors, that sensor(s) is deemed to have failed in block 130. For example, if a signal from one of the active sensors differs from signals of others of the active sensors by between about ±2% and about ±5%, that sensor or sensors may be deemed to have failed. In essence, a failed sensor may be deemed a sensor that represents an outlier relative to others of the sensors. The outlier may be defined as a sensor reporting a reading that is about 1.5 times an inner quartile range of the active sensors Upon detecting a failed sensor, sensor failure detection and fusion system 60 fuses the signals from others of the active sensors in block 140 and determines a parameter of elevator car 20 in block 150. As noted above, the parameter of elevator car 20 may be position, velocity and/or orientation. In accordance with an aspect of an exemplary embodiment, all healthy (non-faulty) active sensors may be fused. In accordance with another aspect of an exemplary embodiment, only those healthy sensors in the same group, e.g., healthy active ones of the first plurality of sensors 47 or healthy active ones of the second plurality of sensors 49 are fused. Regardless of which sensors are fused, the parameter is passed to motion control system 44 in block 160 which, as discussed above, shifts elevator car 20 along lane 4.

In accordance with another aspect of an exemplary embodiment, sensor fault detection and fusion system 80 may also calibrate select ones of the first and second pluralities of sensors 47 and 49 as indicated in block 180. More specifically, sensor failure detection and fusion system 80 may determine small differences, e.g., differences on an order of about less than about 2% of a predetermined error bounds for each of the first and second pluralities of sensors 47 and 49. Sensor failure detection and fusion system 80 may then employ those differences to dynamically calibrate select ones of the first and second pluralities of sensors 47 and 49 to reduce variation and, as a consequence, reduce controller-induced vertical vibration to improve ride quality.

At this point, it should be understood that exemplary embodiments describes a system for detecting faults in, and fusing remaining ones of, a plurality of sensors. It should also be understood that the exemplary embodiments may be employed to detect faults in motor primary portions and/or motor secondary portions. It should also be understood, that the exemplary embodiments may provide an alert to maintenance personnel indicating a need for sensor and/or motor component repair, replacement and/or calibration. Further, while describes as receiving signals from sensors associated with active motor primaries, or motor primaries receiving power, it is contemplates that signals may be received from sensors associated with inactive motor primaries. The system of the present invention improves an overall reliability of the elevator system by immunizing the motion control system from individual sensor failures. Thus, the exemplary embodiments improve an overall reliability of the motion control system by reducing downtime, improving ride performance while providing a desirably level of fault tolerance and redundancy in a system having a multitude of sensors.

The term "about" is intended to include the degree of error associated with measurement of the particular quantity based upon the equipment available at the time of filing the application. For example, "about" can include a range of 8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A multi-car ropeless elevator system comprising:

at least one lane;

an elevator car arranged in the at least one lane;

a linear motor system including a plurality of stationary motor primary sections extending along the at least one lane, and at least one moveable motor secondary section mounted to the elevator car;

a plurality of sensors operatively connected to the linear motor system, each of the plurality of sensors being operatively associated with a corresponding one of the plurality of stationary primary section; and a sensor failure detection and fusion system operatively connected to each of the plurality of sensors, the sensor failure detection and fusion system operating to identify failures in one or more of the plurality of sensors and fuse data received from remaining ones of the plurality of sensors.

2. The multi-car ropeless elevator system according to claim 1, wherein one or more of the plurality of sensors comprise velocity sensors.

3. The multi-car ropeless elevator system according to claim 1, wherein one or more of the plurality of sensors comprise position sensors.

4. The multi-car ropeless elevator system according to claim 3, wherein the position sensors operate to detect a presence of the elevator car in the lane adjacent to the corresponding one of the plurality of stationary motor primary sections.

5. The multi-car ropeless elevator system according to claim 3, wherein the position sensors operate to detect an orientation of the elevator car in the lane relative to the corresponding one of the plurality of stationary motor primary sections.

6. The multi-car ropeless elevator system according to claim 1, further comprising: a motion control system operable to control a position of the elevator car in the lane, the sensor failure detection and fusion system providing at least one of position and velocity feedback of the elevator car to the motion control system.

7. The multi-car ropeless elevator system according to claim 1 wherein the plurality of stationary motor primary sections includes a first plurality of stationary motor primary sections arranged along a first side of the lane and a second plurality of station motor primary sections arranged along a second, opposing side of the lane.

8. The multi-car ropeless elevator system according to claim 1, wherein the plurality of sensors includes a first plurality of sensors associated with corresponding ones of the first plurality of stationary motor primary sections and a second plurality of sensors associate with the second plurality of stationary motor primary sections.

9. The multi-car ropeless elevator system according to claim 1, wherein the sensor failure detection and fusion system operates to calibrate one or more of the plurality of sensors based on differences in signals sensed by at least a portion of the plurality of sensors.

10. A method of detecting faults and fusing sensors for a multi-car ropeless elevator system, the method comprising:

activating one or more of a plurality of stationary motor primary sections to shift an elevator car along a lane;

receiving signals from one or more of a plurality of sensors associated with corresponding ones of the plurality of stationary motor primary sections;

determining a faulty sensor based on differences in the signals received by a portion of the plurality of sensors;

fusing signals from remaining ones of the portion of sensors; and determining a parameter of the elevator car based on the fused signals.

11. The method of claim 10, wherein determining the faulty sensor includes comparing sensor values received from a plurality of active sensors.

12. The method of claim 10, wherein fusing signals from remaining ones of the portion of sensors includes combining signals from a plurality of active sensors of the remaining ones of the portion of sensors excluding the faulty sensor to establish a single fused signal output.

13. The method of claim 12, wherein combining the signals includes averaging the signal output of each of the remaining ones of the plurality of sensors.

14. The method of claim 10, wherein determining the parameter of the elevator car includes detecting a position of the elevator car along the lane based on the fused signals.

15. The method of claim 10, wherein determining the parameter of the elevator car includes detecting a velocity of the elevator car along the lane.

16. The method of claim 10, wherein determining the parameter of the elevator car includes detecting an orientation of the elevator car relative to the plurality of stationary motor primary sections.

17. The method of claim 10, further comprising: calibrating one or more of the plurality of sensors based on differences between signals received from a portion of the plurality of signals.

18. The method of claim 17, wherein calibrating the one or more of the plurality of sensors includes detecting differences below a predetermined error bounds between one or more of the portion of the plurality of signals.

19. The method of claim 10, further comprising: controlling movement of the elevator car along the lane with a motion control system based on the parameter of the elevator car.

20. The method of claim 19, wherein controlling movement of the elevator car includes controlling velocity and position of the elevator car in the lane.

* * * * *